US006477970B1

(12) United States Patent
Ayorinde

(10) Patent No.: US 6,477,970 B1
(45) Date of Patent: Nov. 12, 2002

(54) CARGO HOLDING SYSTEM FOR MARINE FREIGHT VESSELS

(75) Inventor: A. John Ayorinde, Lincoln, NE (US)

(73) Assignee: Shade, Inc., Lincoln, NE (US)

( * ) Notice: Subject to any disclaimer, the term of this patent is extended or adjusted under 35 U.S.C. 154(b) by 3 days.

(21) Appl. No.: 09/723,073

(22) Filed: Nov. 27, 2000

(51) Int. Cl.[7] ..... B03B 25/02
(52) U.S. Cl. ..... 114/73; 114/74 R
(58) Field of Search ..... 114/73, 74 R, 114/72

(56) References Cited

U.S. PATENT DOCUMENTS 5,225,812 A * 7/1993 Faghri ..... 114/228
5,921,421 A * 7/1999 Fuquan ..... 114/74 R

* cited by examiner

*Primary Examiner*—Jesus D. Sotelo
(74) *Attorney, Agent, or Firm*—John R. Hoffman

(57) ABSTRACT

A cargo holding system is provided for a marine freight vessel. The system includes a plurality of filament composite walls defining a cargo holding cavity of the vessel. A liquid impervious liner is disposed about the cavity within the walls for holding liquid cargo. The liner is collapsible to allow solid cargo to be loaded into the holding cavity.

31 Claims, 7 Drawing Sheets

CARGO HOLDING SYSTEM FOR MARINE FREIGHT VESSELS

FIELD OF THE INVENTION

This invention generally relates to the art of ocean-type vessels and their cargo transporting capabilities and, particularly, to cargo holding systems in marine freightliners or the like.

BACKGROUND OF THE INVENTION

Commercial marine freightliners are used to transport the majority of cargo around the world. When transporting liquid cargo, such as oil or the like, such vessels often are called "tankers". A typical design for a tanker involves the use of large hull areas which are divided into compartments or "tanks" that are surrounded by heavy bulkheads typically of steel construction. The versatility of such liquid-carrying vessels is limited to the very nature of the liquid product.

For instance, a major problem with liquid cargo marine vessels is that the liquid is carried on their outward journey with no guarantee that they will find liquid cargo for their homeward bound journey. Considerable profits are lost whenever a vessel or cargo ship must return with empty or substantially empty tanks. There is a need for an effective system which would allow a commercial marine freight vessel to transport either liquid cargo or bulk/solid cargo, as desired, to correct the inefficiency problems discussed above. The present invention is directed to satisfying this need and solving the versatility problems of typical liquid carrying cargo vessels of the character described.

SUMMARY OF THE INVENTION

An object, therefore, of the invention is to provide a new and improved cargo holding system in a marine freight vessel or the like.

In the exemplary embodiment of the invention, the system includes the provision of wall means defining a cargo holding cavity of the vessel. A liquid impervious liner is provided about the cavity within the wall means for holding liquid cargo. The liner is collapsible to allow solid cargo to be loaded into the holding cavity.

As disclosed herein, the liner is fabricated of a corrosion resistant polymer. The liner includes at least a bottom wall and side walls which are foldable on top of the bottom wall. A top wall is foldable onto the side walls and bottom wall. The liner is fabricated of flexible sheet material.

According to another aspect of the invention, the wall means which defines the cargo holding cavity of the vessel includes at least one wall fabricated of a chemical resistant filament composite material. The wall includes opposite filament composite skin layers sandwiching a reinforcement structure therebetween. The skin layers may include glass fibers, graphic fibers or the like. In the preferred embodiment, the reinforcement structure includes a plurality of reinforcing beams. A core structure also may be disposed between the opposite skin layers. The core structure may be a honeycomb core and may be filled with insulating material.

The invention contemplates that the composite wall means include at least one wall which is collapsible along with the collapsible liner. For instance, the collapsible wall may include a plurality of wall sections connected by hinge means.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENTS

Figure 1:
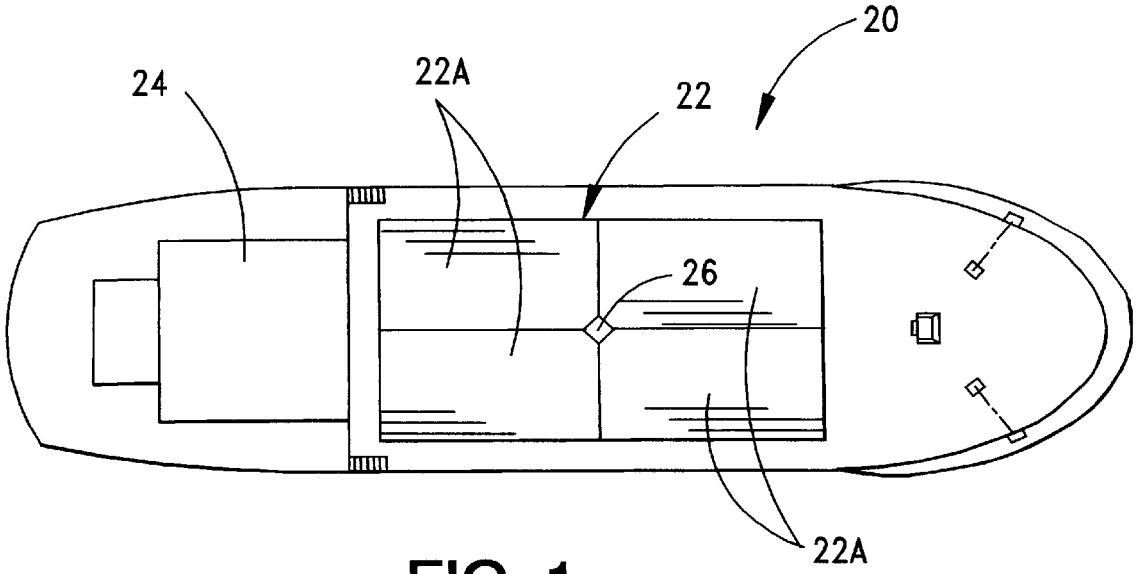
FIG. 1 is a schematic top plan view of a typical marine freight vessel or "tanker" according to the prior art.

Referring to the drawings in greater detail, and first to FIG. 1, the configuration or layout of a typical marine freight vessel, generally designated 20, is shown and is in a configuration of a "tanker" for transporting liquid cargo. The vessel includes a cargo-holding area, generally designated 22, in front of a ship tower 24. Cargo holding area 22 typically is a large tank divided into four compartments 22A with a pump shaft 26 centrally therebetween. The surrounding walls of the tank and the dividing partitions of the compartments are of heavy stainless steel on the order of 8 mm thick. All of the walls are stationary which results in tanker or vessel 20 being capable of carrying only liquid cargo. Therefore, major cost or profit problems are caused when the vessel carries liquid cargo on an outward journey and cannot find liquid cargo for the return or homeward bound journey. The present invention described hereinafter solves these problems.

Figure 2:
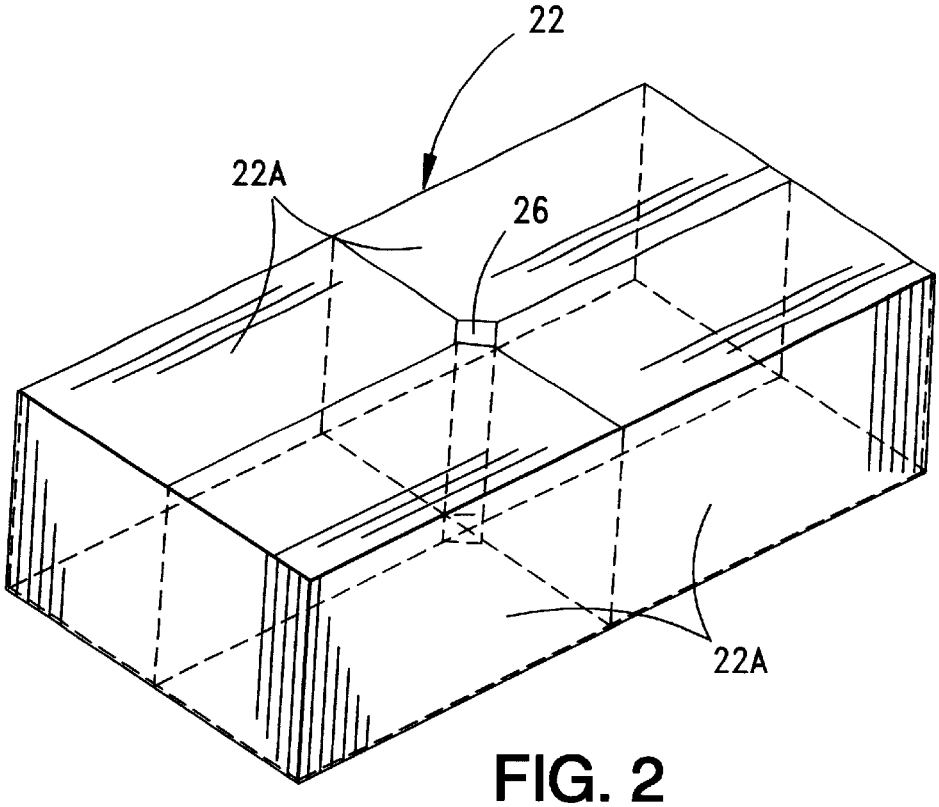
FIG. 2 is a schematic illustration of the tank compartments of the vessel of FIG. 1.
Figure 3:
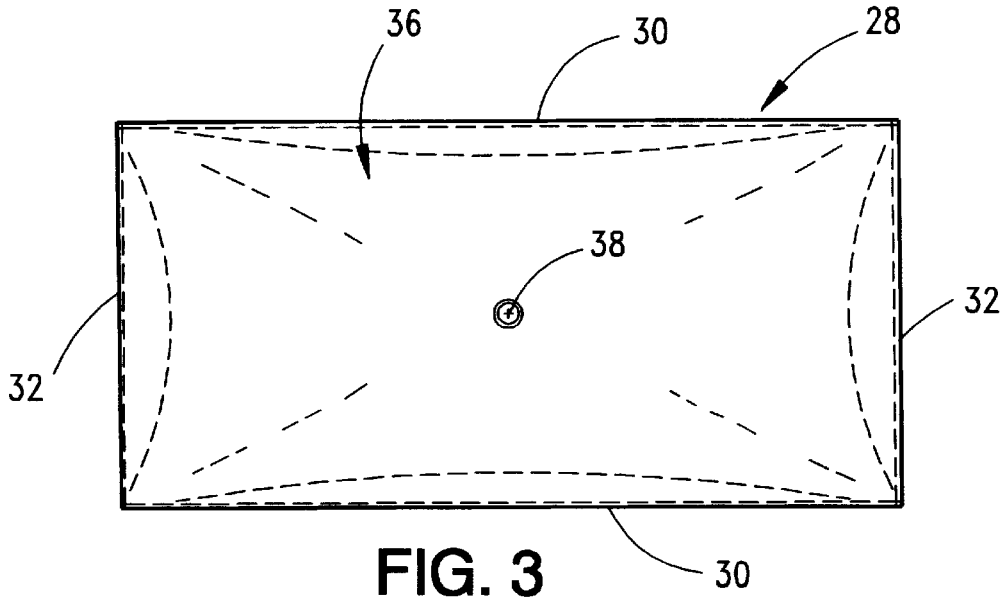
FIG. 3 is a top plan view of a cargo holding system according to the invention.
Figure 4:
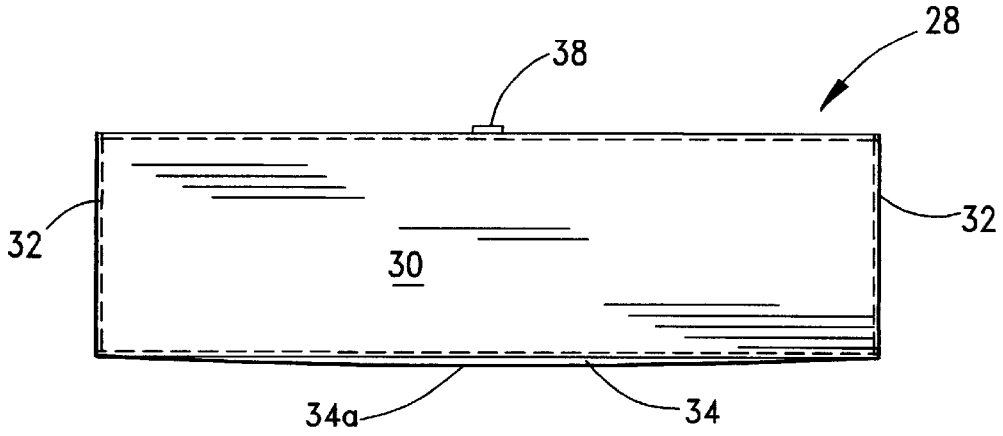
FIG. 4 is a side elevational view of the system.
Figure 5:
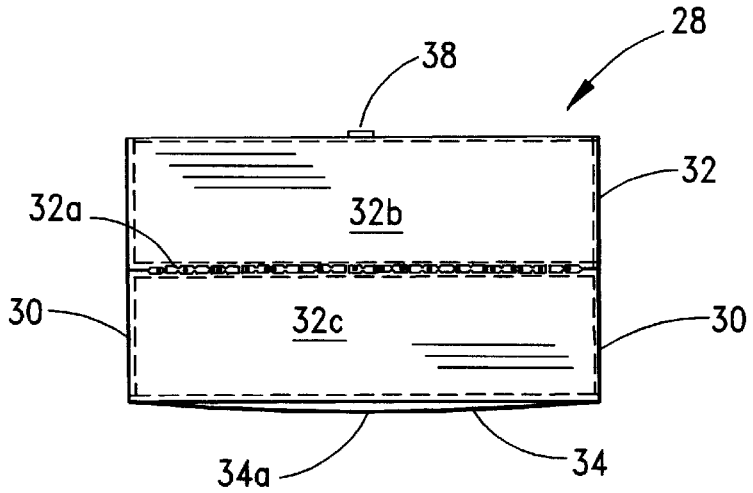
FIG. 5 is an end elevational view of the system.

More particularly, FIGS. 3–5 show a cargo holding system, generally designated 28, incorporating the concepts of the invention. The parameters of system 28 are such as to have a size and shape corresponding to cargo holding area 22 in vessel 20 of FIG. 1, to facilitate an understanding of the advantages of the invention. However, the novel concepts of the invention, including the collapsible liner described hereinafter, the collapsible wall structures and the composite structure of the walls, themselves, have wide applications in various sizes, shapes or configurations other than that shown. For instance, while the system of FIGS. 3–5 is sized corresponding to the entire cargo area 22 (FIGS. 1 and 2), similar smaller or individual systems can be used for each compartment 22A in FIGS. 1 and 2. Therefore, the cargo holding system of the invention not only will allow a marine freight vessel to carry either a liquid cargo or a solid cargo, the vessel may have separate compartments whereby the same vessel can carry both liquid and solid cargo on the same journey.

With that understanding, system 28 shown in FIGS. 3–5 incorporate a wall means defining the cargo area and includes a pair of side walls 30, a pair of end walls 32 and a bottom wall 34 as will be seen hereinafter. Any one or all of the walls are fabricated of a lightweight, very strong composite material. Bottom wall 34 may be tapered to a center point 34*a* for draining purposes. End walls 32 may be hinged, as at 32*a* (FIG. 5), for collapsing or folding purposes as described hereinafter. System 28 of the invention contemplates the use of a collapsible liner, generally designated 36, within the cargo holding cavity defined by walls 30,32 and 34. The liner is fabricated of flexible sheet material and of a corrosion resistant polymer. The liner has a top central opening 38.

Figure 6:
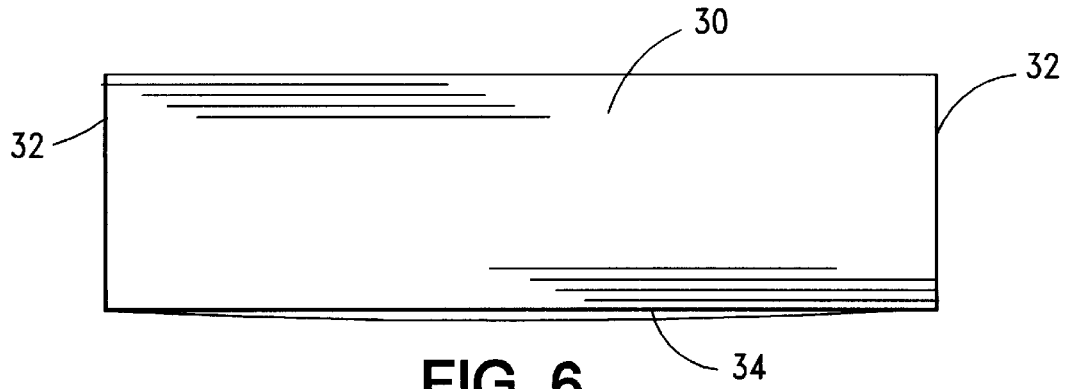
FIG. 6 is a schematic illustration of the bottom wall and end walls of the system.
Figure 7:
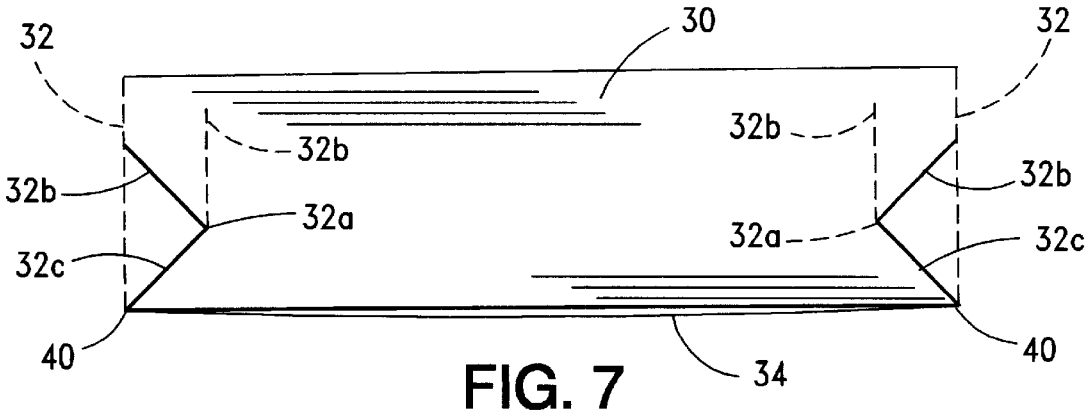
FIG. 7 is a view similar to that of FIG. 6, with the end walls being folded or collapsed.
Figure 8:
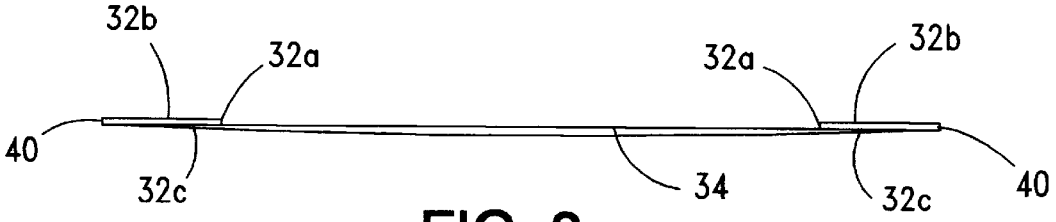
FIG. 8 is a view similar to that of FIG. 7, with the end walls completely collapsed.

FIGS. 6 and 7 show how end walls 32 (FIG. 6) are collapsible or foldable about hinges 32*a* until the end walls are completely folded onto bottom wall 34 as seen in FIG. 8. Actually, each end wall 32 has a top section 32*b* and a bottom section 32*c* which are joined by one of the hinges 32*a*. Each bottom end wall section 32*c* is hinged to a respective end of bottom wall 34 at another hinge 40.

Figure 9:
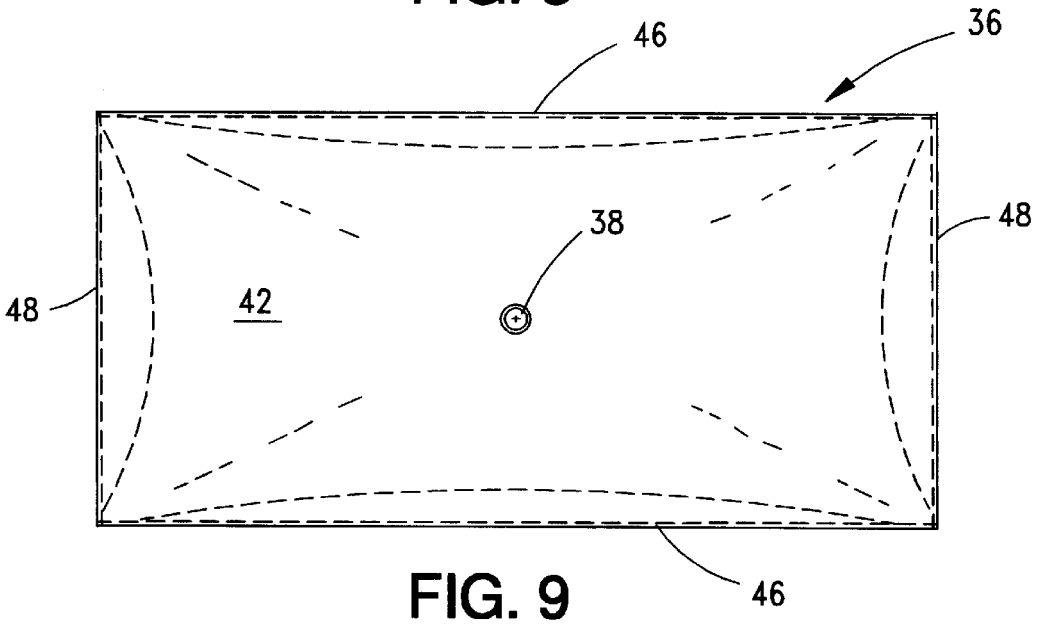
FIGS. 9, 10 and 11 are top plan, side elevational and end elevational views, respectively of the liner of the system of FIGS. 3–5.
Figure 10:
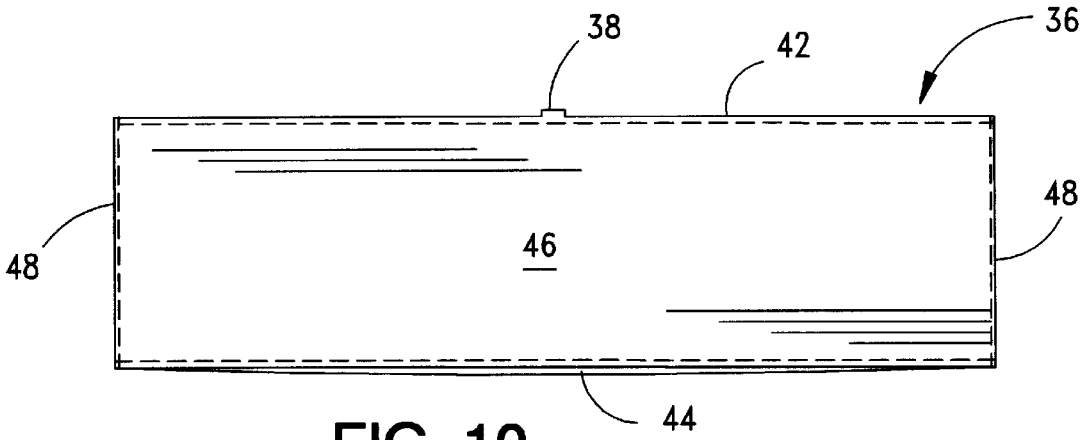
Figure 11:
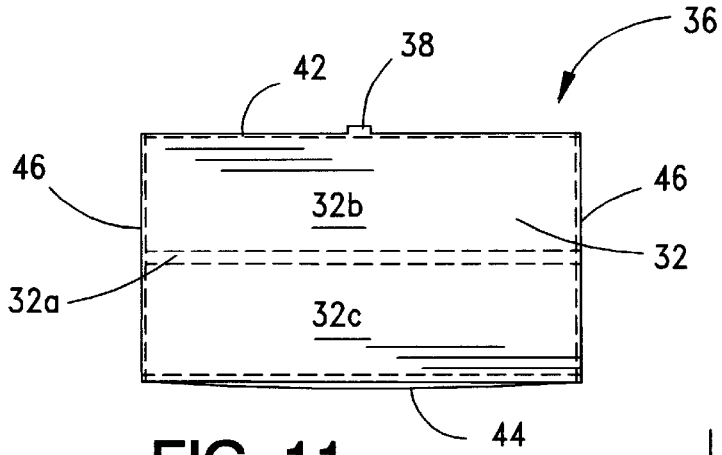

FIGS. 9–11 show liner 36 of the cargo holding system 28 (FIGS. 3–5) according to the invention. As stated above, the liner is fabricated of flexible sheet material. The liner also is fabricated of a corrosion resistant polymer, such as polyvinyidifluoride, polytetrafluoroethylene, floroethylenepolymer, chlorotetrafloroethylene or the like. The liner is completely closed except for opening 38 and includes a top wall 42, a bottom wall 44, opposite side walls 46 and opposite end walls 48. The liner is sized and configured for nesting within the composite walls 30, 32 and 34 described above in relation to FIGS. 3–5. Opening 38 may be sufficiently large to provide a manway into the liner and will include an appropriate sealing cap or cover.

Figure 12:
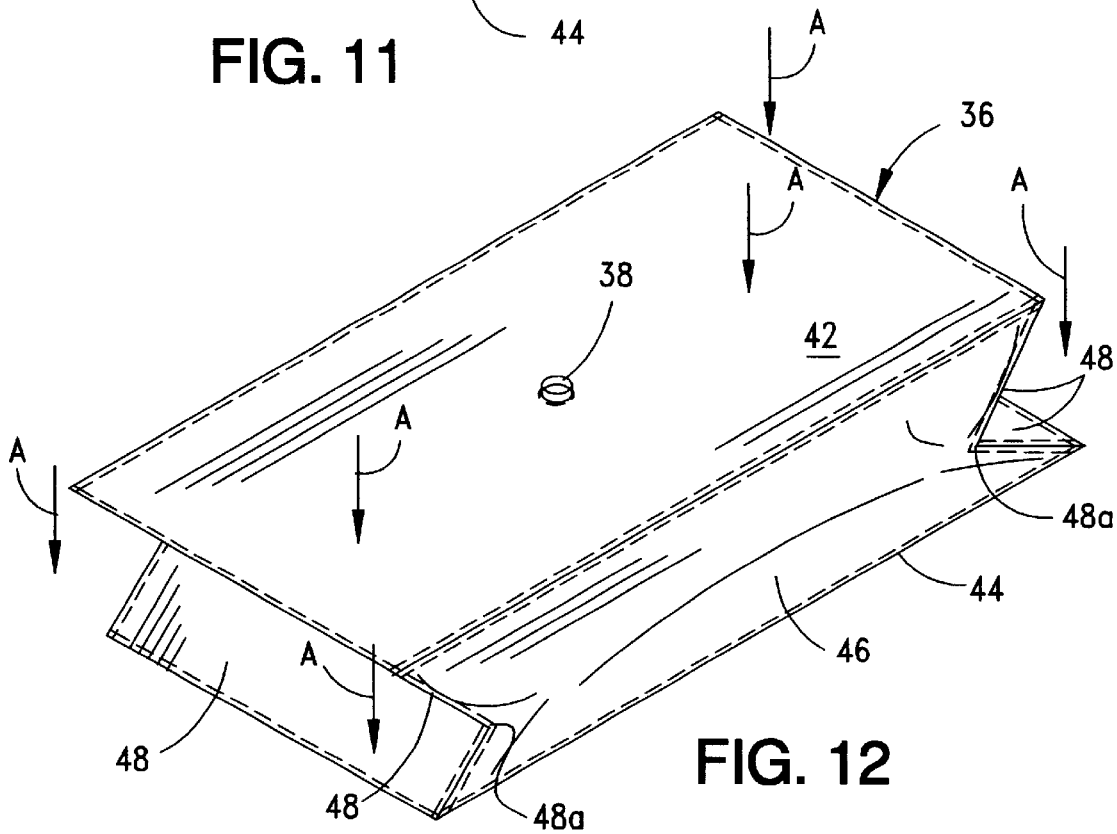
FIG. 12 is a perspective view of the liner folding configuration.

FIG. 12 shows how liner 36 is collapsible in the direction of arrows "A". Actually, top wall 42 of the liner simply drops downwardly onto bottom wall 44 as side walls 46 and end walls 48 collapse or fold inwardly. In comparing FIG. 12 with FIG. 7, collapsible composite end walls 32 facilitate folding or collapsing liner 36, whereby end wall sections 32*b* and 32*c* push inwardly on end walls 48 of the liner. It can be seen that fold lines 48*a* (FIG. 12) of the liner correspond to the indentions of hinges 32*a* (FIG. 7) of the composite end walls.

Figure 13:
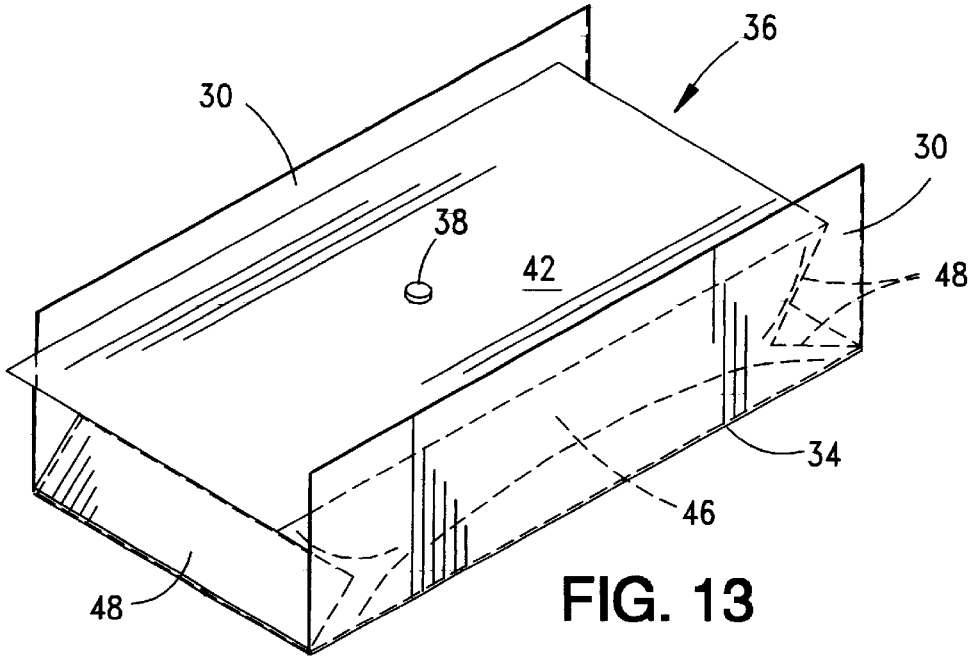
FIG. 13 is a perspective view of the liner folding configuration within the side walls of the system.

FIG. 13 simply shows a schematic illustration to illustrate how liner 36 collapses as shown in FIG. 12 within composite side walls 30 which remain upright or permanent during the collapsing of the liner and composite end walls 32.

Figure 14:
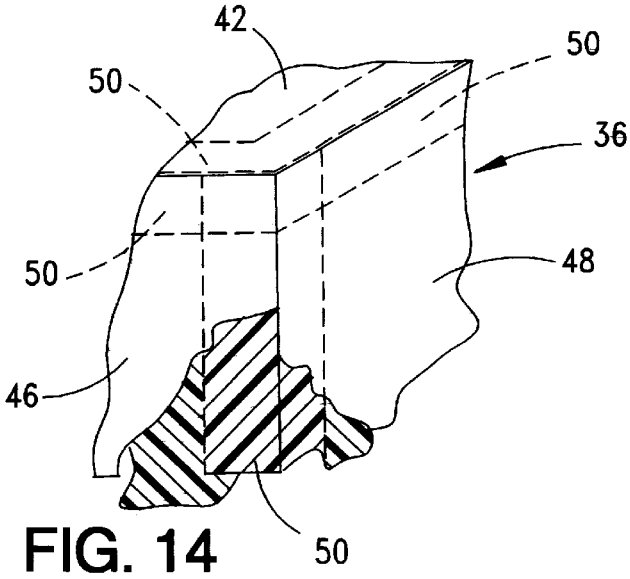
FIG. 14 is a fragmented perspective view at one of the corners of the liner to show the interior reinforcements thereof.

FIG. 14 shows that liner 36 preferably is reinforced at all corners and edges by flexible reinforcing strips. These strips or plies may be molded into the corners and edges of the liner and may be of such material as Kevlar to increase the repeated folding and unfolding of the liner.

Figure 15A:
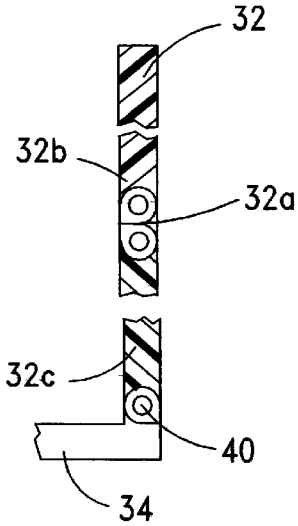
FIGS. 15A, 15B and 15C are sequential views showing the sequence of folding one of the end walls of the system.
Figure 15B:
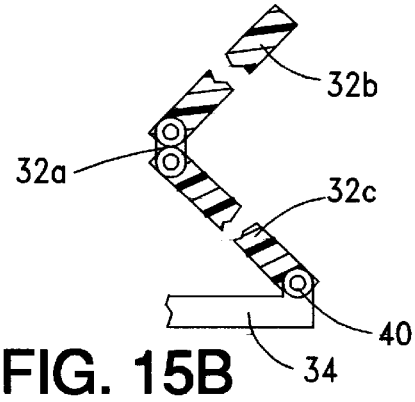
Figure 15C:
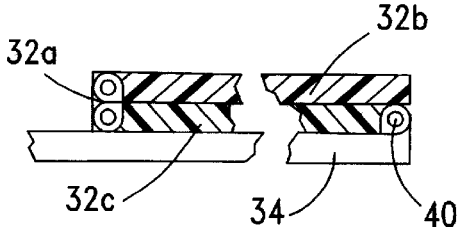

FIGS. 15A–15C simply show schematic illustrations of how upper and lower end wall sections 32*b* and 32*c* of composite end walls 32 are hinged to each other and to bottom composite wall 34. In particular, hinge 32*a* can be seen to be a double hinge to allow upper end wall section 32*b* to pivot inwardly and downwardly onto lower end wall section 32*c*, as the lower end wall section pivots inwardly and downwardly about single hinge 40 onto bottom composite wall 34.

Figure 16:
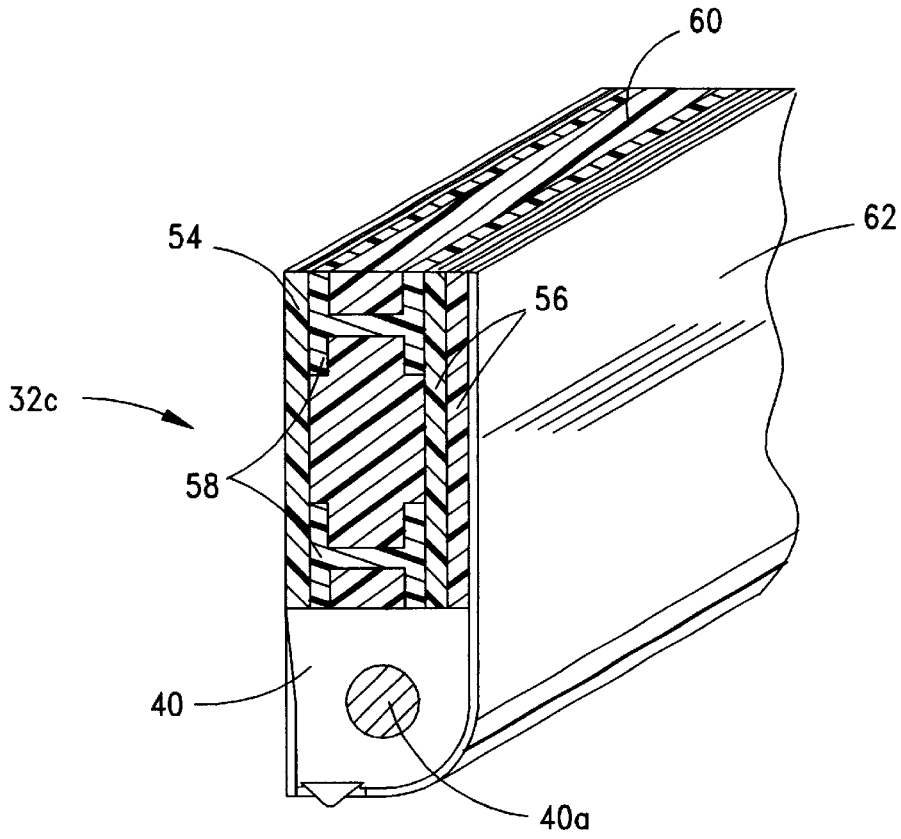
FIG. 16 is an enlarged sectional perspective view showing a typical wall section of the system.

FIG. 16 shows the composition of the wall means for system 28 which includes side walls 30, end walls 32 and bottom wall 34. However, FIG. 16 shows only the lower end wall section 32*c* as viewed in FIG. 7, it being understood that all of the other walls would be fabricated of the same lightweight composition. To that end, it can be seen that lower wall section 32*c* in FIG. 16 includes hinge 40 having a hinge shaft 40*a*.

More particularly, FIG. 16 shows that each composite wall includes an outside filament composite skin layer 54 and at least one inside filament composite skin layer 56. In the preferred embodiment shown, a double inside skin layer is being used. Each skin layer 54 or 56 is fabricated of glass or graphite fibers or filaments in a thermoplastic or thermal setting resin and is layed up in one or more plies thereof. Generally, a reinforcement structure is disposed between outer and inner skin layers 54 and 56, respectively. In the preferred embodiment, the reinforcement structure comprises a plurality of I-beams 58 which may be pultruded and reinforced with continuous glass or graphic fibers. Generally, a core structure 60 is disposed between outer and inner skin layers 54 and 56, respectively. In the preferred embodiment, the core structure is a honeycomb core preferably filled with insulative material. The core may be an aluminum core filled with foam material, for instance. Finally, a chemical resistant, elastomeric liner 62 is adhered to the innermost filament composite skin layer 56. The thickness of the composite wall structure may vary but, regardless, the composite structure is significantly lighter than conventional stainless steel used in the tanks of conventional marine freight vessels.

Figure 17A:
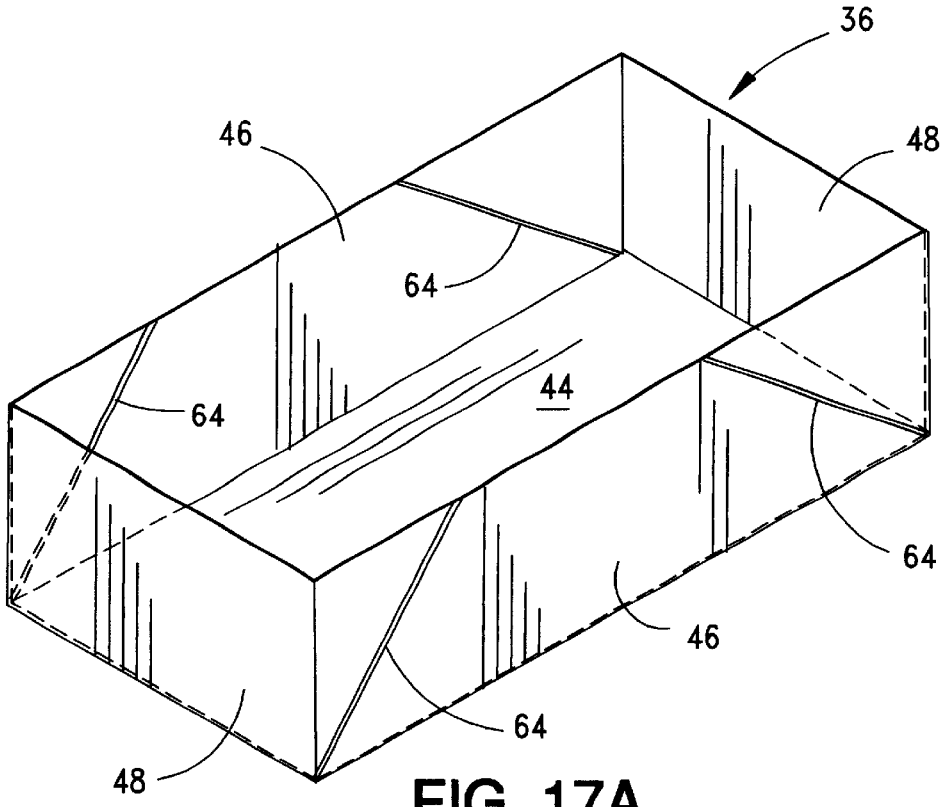
FIGS. 17A and 17B show an alternate folding configuration of the system.
Figure 17B:
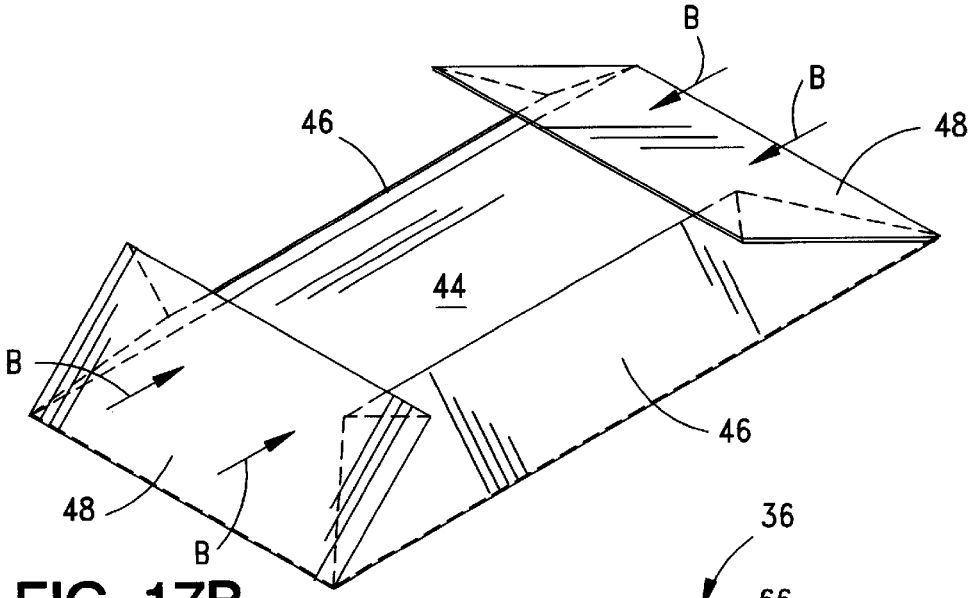
Figure 18A:
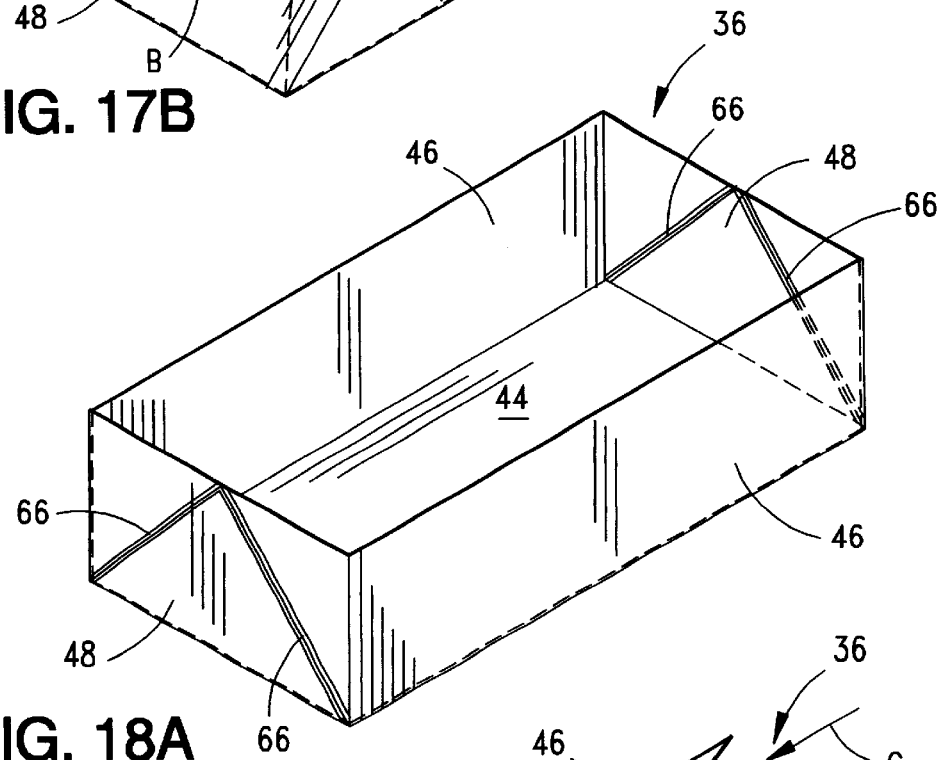
FIGS. 18A and 18B how a further alternate folding configuration of the system.
Figure 18B:
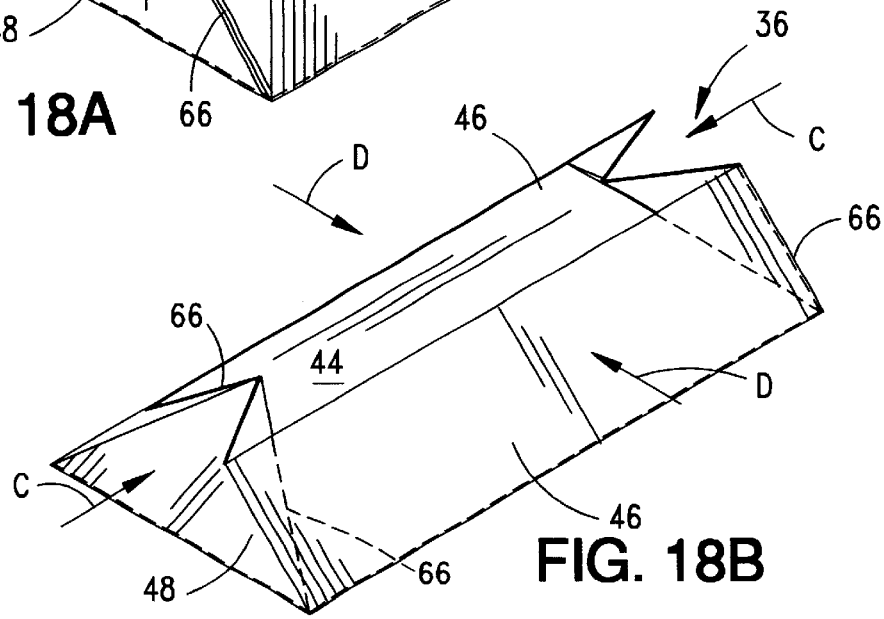

Finally, FIGS. 17A–18B show alternate methods of folding or collapsing liner 36. For instance, FIGS. 17A and 17B show that side walls 30 of the liner are the walls which have folds 64, and end walls 32 remain intact and are folded inwardly in the direction of arrows "B" (FIG. 17B). With this alternative folding method, hinged walls 32 shown in FIGS. 7, 8 and 15A–15C may not be necessary. FIGS. 18A and 18B show end walls 32 of the liner having triangulated fold lines 66. In this alternative, the end walls are folded inwardly in the direction of arrows "C" (FIG. 18B), and side walls 30 remain intact and are folded inwardly in the direction of arrows "D".

A strong vacuum may be used to evacuate liner 36 into a flat configuration. To load liquid cargo, the liner is inflated with air and, preferably, an inert gas such as nitrogen. A hole can be made in bottom wall 44 of the liner for draining.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. A cargo holding system in a marine freight vessel, comprising:

wall means defining a cargo holding cavity of the vessel and including at least one wall fabricated at least in part of a chemical resistant filament composite material;

a liquid impervious liner about the cavity within the wall means for holding liquid cargo; and said liner being collapsible to allow solid cargo to be loaded into the holding cavity.

2. The cargo holding system of claim 1 wherein said liner is fabricated of a corrosion resistant polymer.

3. The cargo holding system of claim 2 wherein said liner includes at least a bottom wall and side walls which are foldable on top of the bottom wall.

4. The cargo holding system of claim 3 wherein said liner includes a top wall foldable onto the side walls and bottom wall.

5. The cargo holding system of claim 1 wherein said liner is fabricated of flexible sheet material.

6. The cargo holding system of claim 1 wherein said at least one wall includes opposite filament composite skin layers sandwiching a reinforcement structure therebetween.

7. The cargo holding system of claim 6 wherein at least one of said skin layers includes glass fibers.

8. The cargo holding system of claim 1 wherein at least one of said skin layers includes graphite fibers.

9. The cargo holding system of claim 6 wherein said reinforcement structure includes a plurality of reinforcing beams.

10. The cargo holding system of claim 1 wherein said at least one wall includes opposite filament composite skin layers sandwiching a core structure therebetween.

11. The cargo holding system of claim 10 wherein said core structure includes a honeycomb core.

12. The cargo holding system of claim 11 wherein said honeycomb core is filled with insulating material.

13. A cargo holding system in a marine freight vessel, comprising:

wall means defining a cargo holding cavity of the vessel and including at least one wall fabricated at least in part of a chemical resistant filament composite material;

a liquid impervious liner about the cavity within the wall means for holding liquid cargo, the liner being fabricated of flexible sheet material of a corrosion resistant polymer; and said liner including a bottom wall, a top wall and a plurality of side walls, the liner being collapsible to allow solid cargo to be loaded into the holding cavity with the side walls being foldable on top of the bottom wall and the top wall being foldable onto the side walls and the bottom wall.

14. The cargo holding system of claim 13 wherein said at least one wall includes opposite filament composite skin layers sandwiching a reinforcement structure therebetween.

15. The cargo holding system of claim 14 wherein said reinforcement structure includes a plurality of reinforcing beams.

16. The cargo holding system of claim 13 wherein said at least one wall includes opposite filament composite skin layers sandwiching a core structure therebetween.

17. The cargo holding system of claim 16 wherein said core structure includes a honeycomb core.

18. The cargo holding system of claim 17 wherein said honeycomb core is filled with insulating material.

19. A cargo holding system in a marine freight vessel, comprising:

a plurality of walls defining a cargo holding cavity of the vessel, at least one of said walls including a pair of filament composite skin layers, and a reinforcement structure sandwiched between the skin layers.

20. The cargo holding system of claim 19 wherein at least one of said skin layers includes glass fibers.

21. The cargo holding system of claim 19 wherein at least one of said skin layers includes graphite fibers.

22. The cargo holding system of claim 19 wherein said reinforcement structure includes a plurality of reinforcing beams.

23. The cargo holding system of claim 19 wherein said reinforcement structure includes a core structure between said skin layers.

24. The cargo holding system of claim 23 wherein said core structure includes a honeycomb core.

25. The cargo holding system of claim 24 wherein said honeycomb core is filled with insulating material.

26. The cargo holding system of claim 19, including a chemical resistant elastomeric layer on an inside one of said skin layers.

27. A cargo holding system in a marine freight vessel, comprising:

wall means defining a cargo holding cavity of the vessel;

a liquid impervious liner about the cavity within the wall means for holding liquid cargo;

said liner being collapsible to allow solid cargo to be loaded into the holding cavity; and said wall means including at least one wall which is collapsible along with the collapsible liner.

28. The cargo holding system of claim 27 wherein said collapsible wall includes a pularilty of wall sections connected by hinge means.

29. A cargo holding system in a marine freight vessel, comprising:

wall means defining a cargo holding cavity of the vessel;

a liquid impervious liner about the cavity within the wall means for holding liquid cargo, the liner being fabricated at flexible sheet material of a corrosion resistant polymer;

said wall means including at least one wall which is collapsible along with the collapsible liner.

30. The cargo holding system of claim 29 wherein said collapsible wall includes a plurality of wall sections connected by hinge means.

31. A method of providing a cargo holding system in a marine freight vessel having wall means defining a cargo holding cavity of the vessel, comprising the steps of:

providing a liquid impervious liner about the cavity within the wall means for holding liquid cargo, the liner including a bottom wall, a top wall and side walls; and collapsing said liner to allow solid cargo to be loaded into the holding cavity above the liner, including folding the side walls on top of the bottom wall and the top wall onto the side walls and the bottom wall.

* * * * *